US006279843B1

(12) United States Patent
Coldren et al.

(10) Patent No.: US 6,279,843 B1
(45) Date of Patent: Aug. 28, 2001

(54) SINGLE POLE SOLENOID ASSEMBLY AND FUEL INJECTOR USING SAME

(75) Inventors: Dana R. Coldren, Fairbury; Glen F. Forck, Peoria, both of IL (US); Prabhakar Ramalingam, Cary, NC (US); Trent A. Riggs, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/528,975

(22) Filed: Mar. 21, 2000

(51) Int. Cl.[7] ..... B05B 1/30

(52) U.S. Cl. ..... 239/585.1; 239/585.4; 239/585.5; 251/129.15

(58) Field of Search ..... 239/585.1, 585.2, 239/585.3, 585.4, 585.5, 583, 584, 124, 88, 90, 91, 95, 96; 251/129.15, 129.16, 129.17, 129.18, 129.19, 129.2, 129.21, 129.22; 137/625.65; 335/255, 278, 281, 296

(56) References Cited

U.S. PATENT DOCUMENTS

| | | |
|---|---|---|
| 2,853,659 | 9/1958 | Herion . |
| 3,970,282 | 7/1976 | Hansen . |
| 4,083,346 | 4/1978 | Eheim . |
| 4,524,797 | 6/1985 | Lungu . |
| 4,646,976 | 3/1987 | Rembold et al. . |
| 4,653,455 | 3/1987 | Eblen et al. . |
| 4,676,478 | 6/1987 | Kiuchi . |
| 4,984,549 | 1/1991 | Mesenich . |
| 5,263,647 | 11/1993 | Cerny et al. . |
| 5,570,842 | 11/1996 | Kindley . |
| 5,752,689 | 5/1998 | Barkhimer et al. . |
| 5,772,180 | 6/1998 | Palma et al. . |
| 5,775,301 | 7/1998 | Gorser . |
| 5,931,139 | 8/1999 | Mack . |
| 5,961,052 | 10/1999 | Coldren et al. . |

FOREIGN PATENT DOCUMENTS

| | | |
|---|---|---|
| 0 007 724 | 2/1980 | (EP) . |

OTHER PUBLICATIONS

Author: Coldren/Moncelle; Title: Advanced Technology Fuel; System for Heavy Duty Diesel Engines; Date: Nov. 17, 1997; Place of Publication: Cleveland, D H.

*Primary Examiner*—Lisa Ann Douglas
(74) *Attorney, Agent, or Firm*—Liell & McNeil

(57) ABSTRACT

A single pole solenoid assembly includes a coil attached to a stator that is in a fixed position relative to a body component. An armature with a centerline is positioned adjacent to the stator. A magnetic flux ring has a central axis and an interior surface that at least partially surrounds the armature. The stator, armature and magnetic flux ring are positioned and arranged such that magnetic flux line generated by the coil pass through the stator and the magnetic flux ring through the armature. The central axis and the centerline are concentrically coupled via an interaction between the magnetic flux ring and the armature via the body component. The single pole solenoid is preferably attached to valving components and incorporated as part of an electronically controlled fuel injector.

20 Claims, 5 Drawing Sheets

(SINGLE POLE)

(DOUBLE POLE)

SINGLE POLE SOLENOID ASSEMBLY AND FUEL INJECTOR USING SAME

TECHNICAL FIELD

The present invention relates generally to solenoid assemblies, and more particularly to single pole solenoid assemblies for use in fuel injectors.

BACKGROUND ART

Although the use of dual pole solenoids appears to dominate in most solenoid applications, single pole solenoids still remain preferred in some applications. In most dual pole solenoid designs, an armature is spaced at an air gap distance away from a stator having a coil embedded therein. When the coil is energized, magnetic flux is generated around the coil, and flux lines pass through the stator, the armature and back to the stator. The resulting flux path produces a pair of magnetic north and south poles between the stator and armature on each side of the air gap. The flux between these poles is parallel to the armature motion. These opposite poles produce a force on the armature that tend to move it in the direction of the stator and coil to accomplish some task, such as close a valve, etc. In the case of a single pole solenoid, a magnetic flux path is created around the coil. In a typical single pole solenoid, the magnetic flux path also encircles the coil and passes through the stator, the armature, and back to the stator. The resulting flux path also produces a pair of magnetic north and south between the stator and the armature. In the single pole configuration, the flux between the poles is parallel to armature motion for one set of poles and perpendicular to armature motion for the other set of poles. Only one set of poles is producing magnetic force for armature motion. In both single and dual pole designs, the armature generally moves toward the stator to reduce the size of the air gap their between.

In many single pole solenoid designs, the armature must also have a radial sliding gap with respect to another electro magnetic component that is present to complete the magnetic circuitry around the coil. Due primarily to manufacturing considerations, this extra magnetic piece is often not included as a portion of the stator, but is generally in contact with the stator, stationary and positioned to complete the magnetic circuit around the coil. Depending upon the configuration of the single pole solenoid, this additional magnetic component is sometimes referred to as a magnetic flux ring. When the coil is energized, the magnetic flux lines encircle the coil but pass sequentially through the stator, the armature, the magnetic flux ring and back to the stator, or vice versa. Since the magnetic flux ring is stationary but the armature moves, there must be some sliding air gaps between these two components. However, those skilled in the art will appreciate that this sliding gap is preferably as small as possible in order to produce the highest possible forces on the armature. When this sliding air gap becomes so small that the armature touches the magnetic flux ring, a high magnetic force is produced but the armature is unable to move. When the sliding gap becomes too large, the magnetic flux can sometimes tend to seek out a lower reluctance path than spanning the sliding gap such that the solenoid can begin to perform like a poorly configured dual pole solenoid.

In general, for a given space and small initial air gap, a dual pole solenoid can almost always be designed that will produce higher forces than that of a single pole solenoid for similar sized initial and final air gaps. This fact usually results in a designer choosing a dual pole solenoid design over a corresponding single pole design.

In some applications, such as in fuel injectors where a single solenoid is moving two different valve members, it is desirable that the solenoid have the ability to stop at an intermediate position. In many instances, it is desirable that the armature have the ability to move from its de-energized position to the intermediate position as quickly as possible; however, it is also often desirable that the solenoid have the ability to stop the armature at the intermediate position without substantial overshooting or significant oscillations about that intermediate position. In many instances, this intermediate position is accomplished by balancing the solenoid force against a compressed spring having a predetermined pre-load. When, as in the case of many fuel injectors, where total armature movement is only on the order of tens of microns, the ability to produce multiple fuel injectors that perform substantially identical when the various components that make up the assembly must inherently have some dimensional tolerancing, is extremely difficult.

The present invention is directed to overcoming these and other problems associated with producing large quantities of solenoid assemblies that perform reliably, uniformly while remaining realistically manufacturable.

DISCLOSURE OF THE INVENTION

A single pole solenoid assembly comprises a body and a stator in a fixed position relative to the body. A coil is attached to the stator. An armature with a centerline is positioned adjacent to the stator. A magnetic flux ring with a central axis has an interior surface at least partially surrounding the armature. The stator, armature and magnetic flux ring are positioned and arranged such that magnetic flux lines generated by the coil pass between the stator and magnetic flux ring through the armature. The central axis of the magnetic flux ring and the centerline of the armature are concentrically coupled via an interaction between the magnetic flux ring and the armature via the body.

BEST MODE FOR CARRYING OUT THE INVENTION

Figure 1:
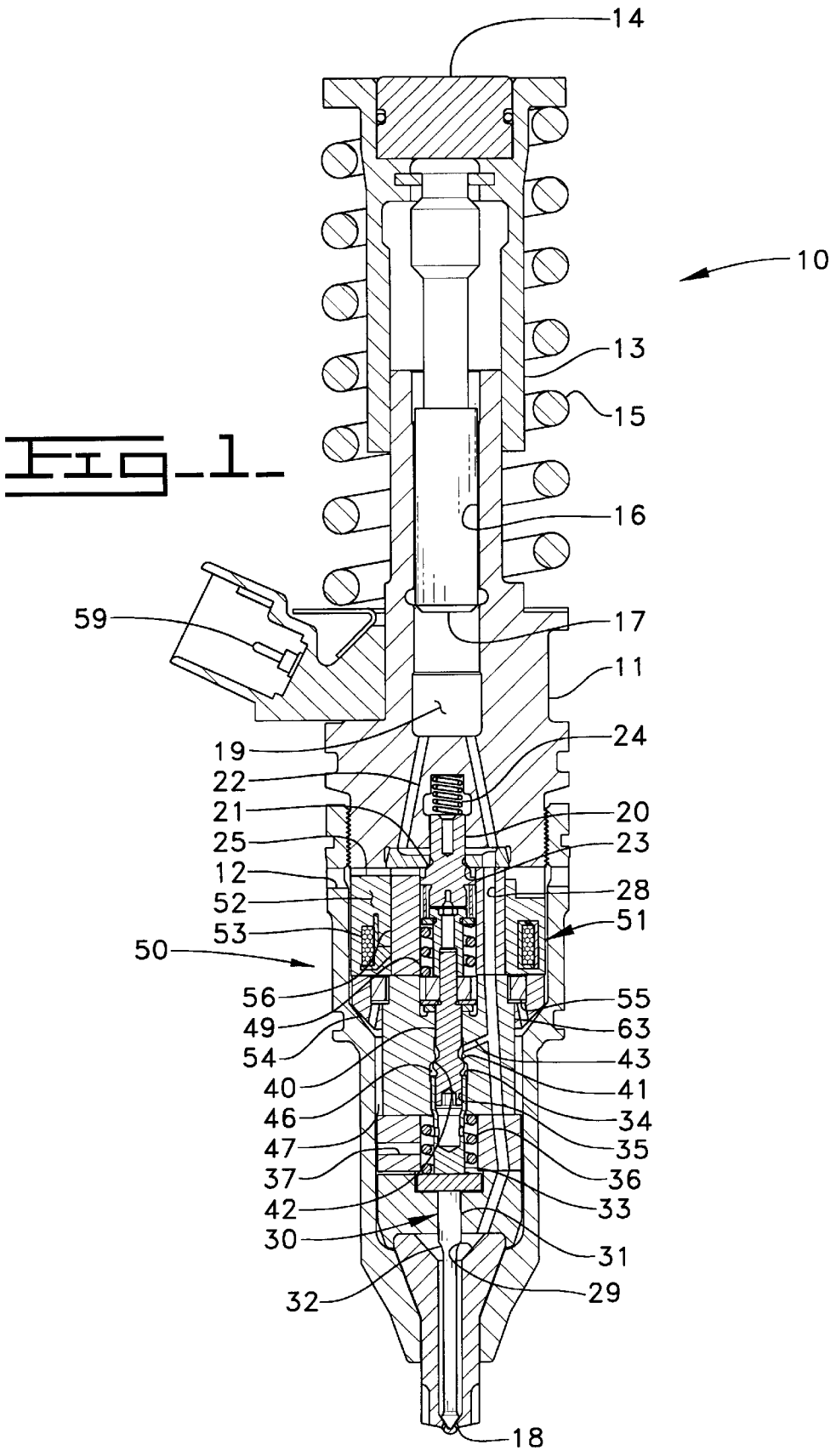
FIG. 1 is a side sectioned diagrammatic view of a fuel injector according to the present invention.

Referring now to FIG. 1, a mechanically controlled electronically actuated fuel injector 10 is housed in an injector body 11 that contains various moving components positioned as they would be just prior to the initiation of an injection event. Injector body 11 includes a fuel inlet 12, which also serves as an outlet spill passage, connected to a source of low pressure fuel, such as distillate diesel fuel.

Injector body 11 also includes a nozzle outlet 18 that is appropriately positioned in or adjacent to a hollow piston cylinder within an internal combustion engine. Fuel injector 10 is actuated via a conventional cam actuated tappet assembly 13 and is controlled via a solenoid controlled valve assembly 50 that is preferably positioned within injector body 11. Valve assembly 50 controls two aspects of injector 10 including positioning of a spill valve member 20, which controls when fuel is pressurized within the injector, and a needle control valve member 40 that controls the opening and closing of direct control needle valve 30 to control timing and quantity of fuel injected. Spill valve member 20 and needle control valve member 40 are controlled in their respective positions by a single pole solenoid assembly 51 that receives electric current via an external connection point in a conventional manner.

Tappet assembly 13 includes a rocker arm contact surface 14 that is in contact with a plunger 17, which is slidably positioned in a plunger bore 16. Plunger 17 and tappet assembly 13 are normally biased toward their retracted positions, as shown, by a conventional return spring 15. One end of plunger 17 and a portion of plunger bore 16 define a fuel pressurization chamber 19, within which fuel is pressurized during each injection event.

Between injection events when plunger 17 is undergoing its retracted stroke, fresh fuel is drawn into fuel pressurization chamber 19 via spill passage 25, past conical valve seat 23 and up fuel flow passage 22. When plunger 17 is undergoing its downward stroke, fuel is displaced from fuel pressurization chamber 19 into spill passage 25 while spill valve member 20 is in its downward opened position. Fuel pressurization chamber 19 is also in fluid communication with nozzle outlet 18 via a nozzle supply passage 28 and a nozzle chamber 29. Each injection event is initiated by the downward travel of plunger 17 and the movement of spill valve member 20 toward its upward closed position in which its valve surface 21 is in contact with conical valve seat 23 to close the fluid connection between spill passage 25 and fuel flow passage 22. Spill valve member 20 is normally biased downward towards its opened position by a spill biasing spring 24.

As stated earlier, the timing and relation of each injection event is controlled by the positioning of a direct control needle valve 30. Direct control needle valve 30 includes a needle valve member 31 having a lifting hydraulic surface 32 exposed to fluid pressure in nozzle chamber 29. Direct control needle valve 30 also includes a piston portion 33 having a closing hydraulic surface 34 exposed to fluid pressure in a needle control chamber 46. Direct control needle valve 30 is normally biased toward its downward closed position by a needle biasing spring 36. Lifting hydraulic surface 32, closing hydraulic surface 34 and the strength of needle biasing spring 36 are preferably chosen such that direct control needle valve 30 will stay in or move toward its closed position when pressure in needle control chamber 46 is high. When pressure in needle control chamber 46 is low, direct control needle valve 30 behaves as a simple spring biased check such that it will move upward toward its open position when the hydraulic force acting on lifting hydraulic surface 32 is sufficient to overcome needle biasing spring 36.

Figure 2:
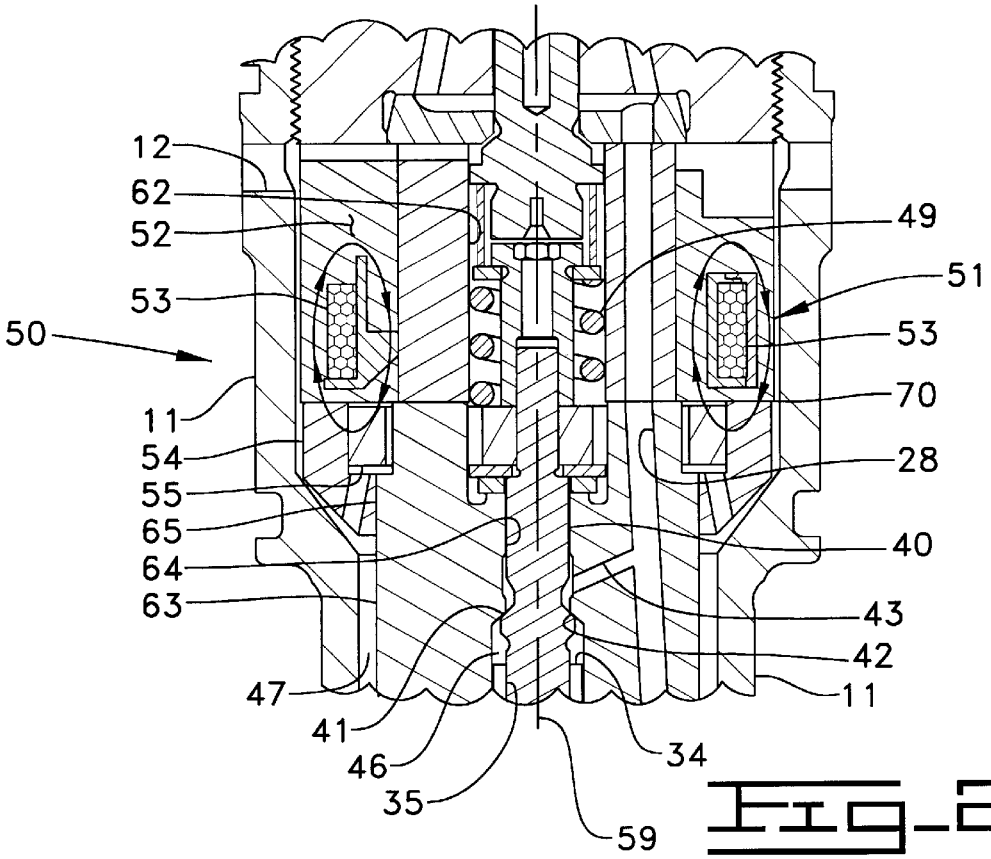
FIG. 2 is a partial sectioned side diagrammatic view of the solenoid controlled valve assembly portion of the fuel injector shown in FIG. 1.

Referring now in addition to FIG. 2, the pressure within needle control chamber 46 is controlled by the positioning of needle control valve member 40. Needle control valve member 40 is normally biased downward toward its high pressure position by a needle control biasing spring 49 and spill biasing spring 24. When in this position, its valve surface 41 is out of contact with a conical valve seat 42 such that needle control chamber 46 is in fluid communication with nozzle supply passage 28 via a pressure communication passage 43. When needle control valve member 40 is in its upward low pressure position, valve surface 41 is in contact with conical valve seat 42, and pressure within needle control chamber 46 becomes relatively low due to a vent clearance 35 that exists between the inner surface of piston portion 33 and the outer surface of valve member 40, and a vent passage 37 that opens to an annular low pressure space 47 in fluid contact with fuel inlet 12.

Needle control valve member 40 is attached to an armature 55, which is a portion of single pole solenoid assembly 51. Spill valve member 20 is operably connected to armature 55 via the conventional spring and spacer linkage shown in FIG. 1.

Figure 4:
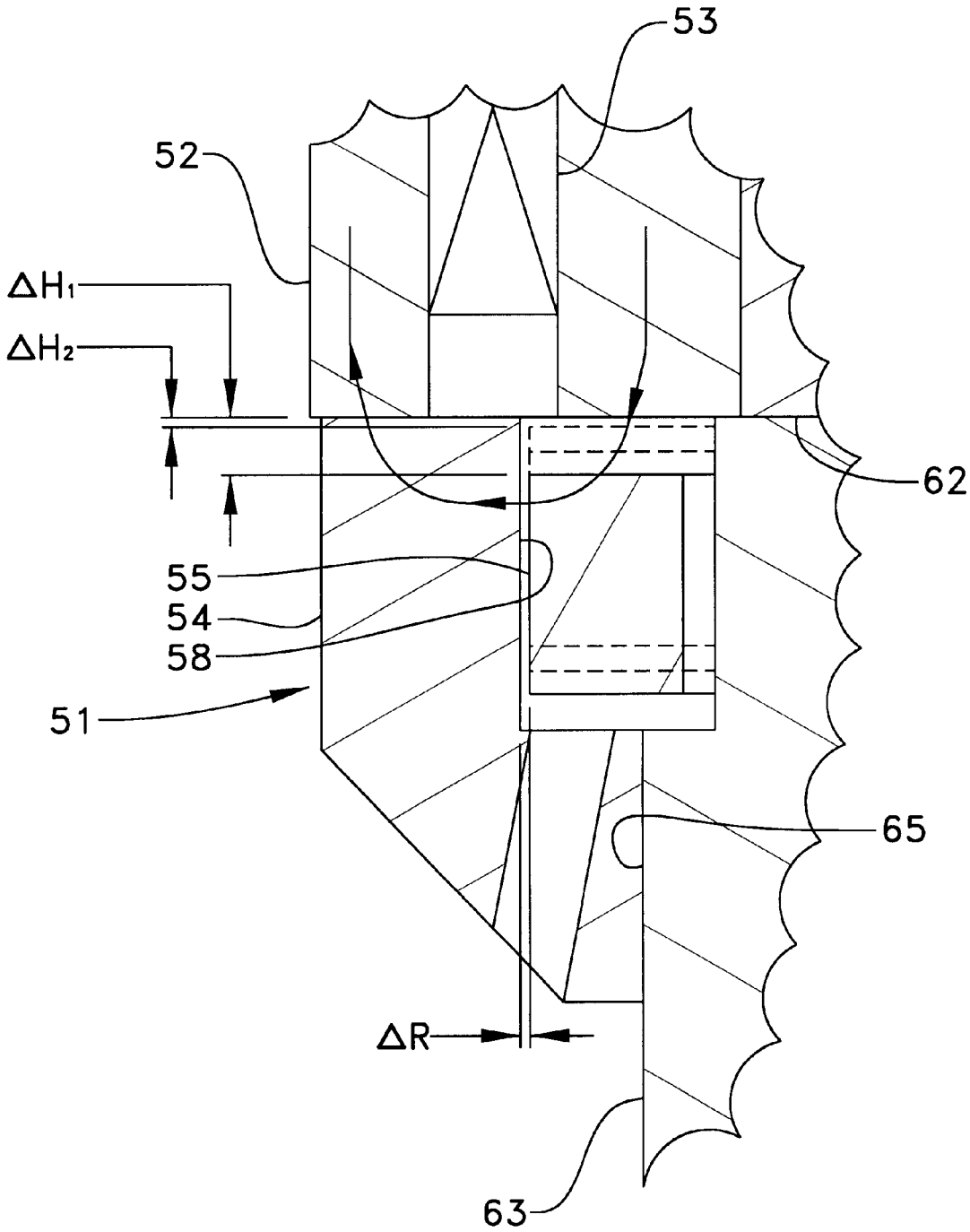
FIG. 4 is an enlarged partial sectioned side diagrammatic view of a single pole solenoid assembly according to the present invention.

Referring now in addition to FIG. 4, single pole solenoid assembly 51 includes a stator 52, within which a coil 53 is positioned, a magnetic flux ring 54 and armature 55. Stator 52, magnetic flux ring 54, and armature 55 are preferably manufactured from a suitable magnetically permeable material, such as silicon iron. This is to be contrasted with the material out of which most of the remaining moving portions of the fuel injector and injector body are made. For instance, body component 62, body component 63, and needle control valve member 40 are preferably made from a material such as high carbon steel that has a relatively high hardness and high fatigue strength, but a relatively low magnetic permeability. It is believed that there are no known materials that exhibit satisfactory characteristics for use in both magnetic and valving components within a fuel injector. In other words, metallic alloys with relatively high magnetic permeability are not generally suitable for use in valving components which require a suitable combination of high hardness and high fatigue strength. In general, it is desirable that any of the components near and especially those in contact with the magnetic components have a relatively low magnetic permeability so that little to no magnetic leakage occurs. Thus, as used in this patent, the term magnetic material refers to a material having relatively high magnetic permeability but a relatively low combination of hardness and fatigue strength. A valving material refers to one having a relatively low magnetic permeability but a relatively high combination of hardness and fatigue strength.

Figure 5:
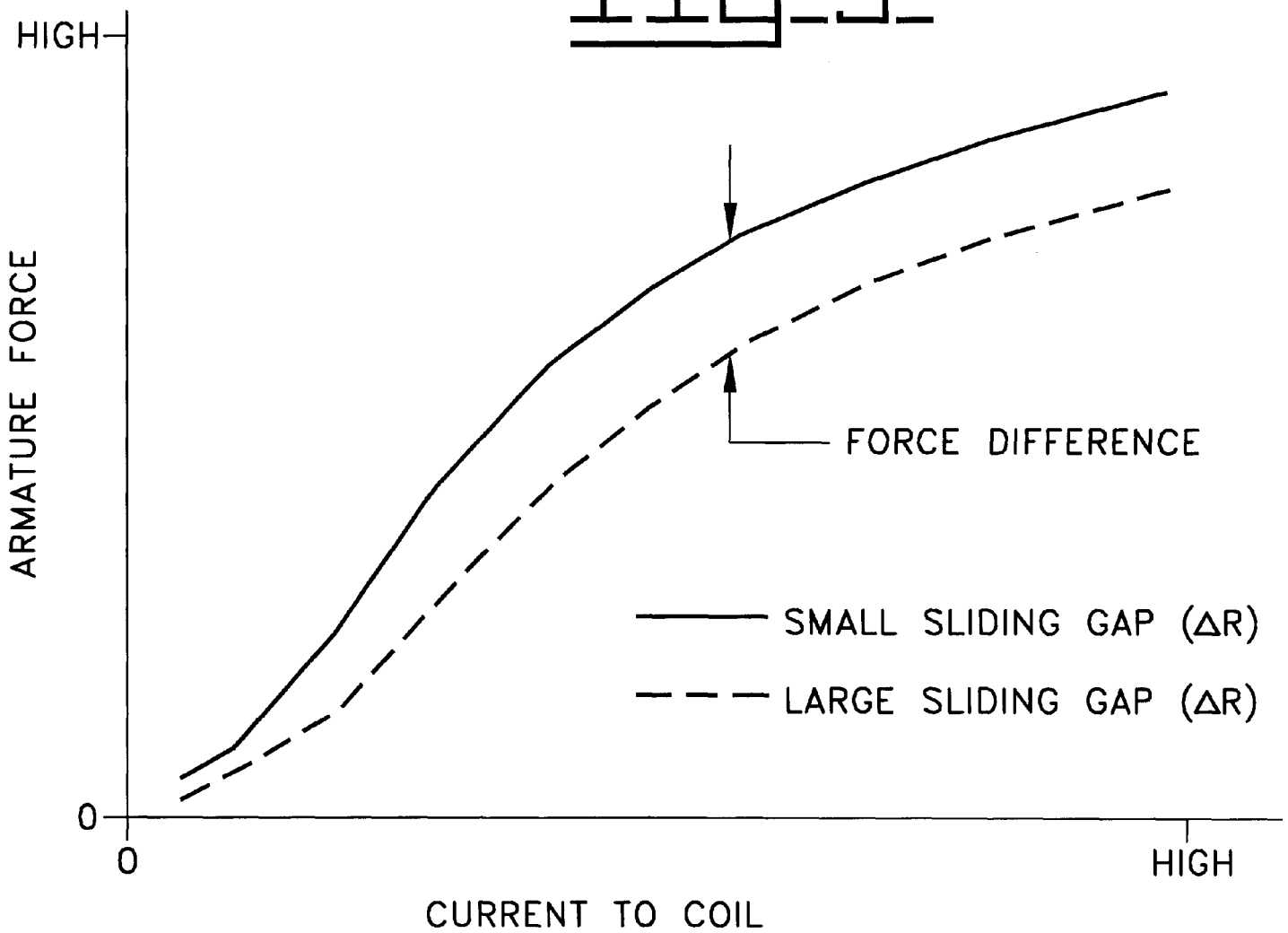
FIG. 5 is a graph of armature force versus current to coil for two single pole solenoids having large and small sliding gaps.

Those skilled in the art will appreciate that in order to get the best possible performance out of single pole solenoid assembly 51, the sliding gap delta R (FIG. 4) is as small as possible. However, those skilled in the art will also appreciate that inevitable geometrical tolerancing in the machining of the various components limits how small that sliding gap can be and still reliably produce large quantities of the single pole solenoid assembly. Thus, any substantial variation in the sliding gap from one solenoid assembly to the next can result in a substantial difference in the performance of the two solenoid assemblies. This phenomenon is illustrated in FIG. 5. Therefore, there is motivation to make the sliding gap delta R as small as possible but also produce a design that results in sliding air gaps that do not vary significantly from one assembly to another. Both of these goals are accomplished in the present invention by concentrically coupling the centerlines of the magnetic flux ring 54 and the armature 55 via an interaction with body component 63. In order to provide this coupling, body component 63 preferably has a cylindrical outer surface in its press fit area 65 that is machined in the same chucking as an internal guide bore 64 (FIG. 2), which receives needle control valve member 40. By machining these features in a suitable manner, the centerline of the cylindrical press fit area 65, and the centerline of cylindrical guide bore 64 can be virtually co-linear. Since the diametrical clearance between needle control valve member 40 and guide bore 64 is relatively small, and because armature 55 is concentrically attached to the valve member 40, the centerline 59 of armature 55 is closely aligned with the centerline of guide bore 64. The magnetic flux ring 54 on the other hand, is press fit attached to the outer cylindrical surface of body component 63. This insures that its cylindrical wall 58 has a centerline nearly co-linear with that of cylindrical press fit area 65. Because the various components should have concentric centerlines, only one centerline 59 has been shown. Since the inner diameter of cylindrical wall 58 and the outer diameter of armature 55 can be machined to relatively tight tolerances, the concentric coupling between these two components results in the ability to make a relatively narrow sliding gap that does not vary significantly from one assembly to another.

Another of these subtle but advantageous features of the present invention lies in the fact that the stator 52 is positioned on one side of the plane 70, and the armature 55 and magnetic flux ring 54 are positioned on the opposite of that plane. Those skilled in the art will appreciate that reducing variabilities in the air gap delta H separating the armature 55 from stator 52 is important in maintaining uniformity in performance from one assembly to another. By machining body component 63 to have a planar top surface and positioning that plane a known and fixed distance from conical valve seat 42, combined with an attachment strategy that locates the top surface of the armature a fixed and known distance away from the valve surface 41, one can relatively reliably position the top surface of armature 51 a known fixed distance below the plane 70 to find the upper surface of body component 63. Since the various components are designed such that the bottom planar surface of stator 52 is co-planar with plane 70, one can reduce the variability in initial air gap delta H(1) and final air gap delta H(2) in the solenoid assembly. Magnetic flux ring 54 is mounted so that its upper surface is flush with the upper planar surface 70 of body component 63 so that the flux ring is in contact with a portion of the lower surface of stator 52 to better facilitate the magnetic flux.

Figure 3:
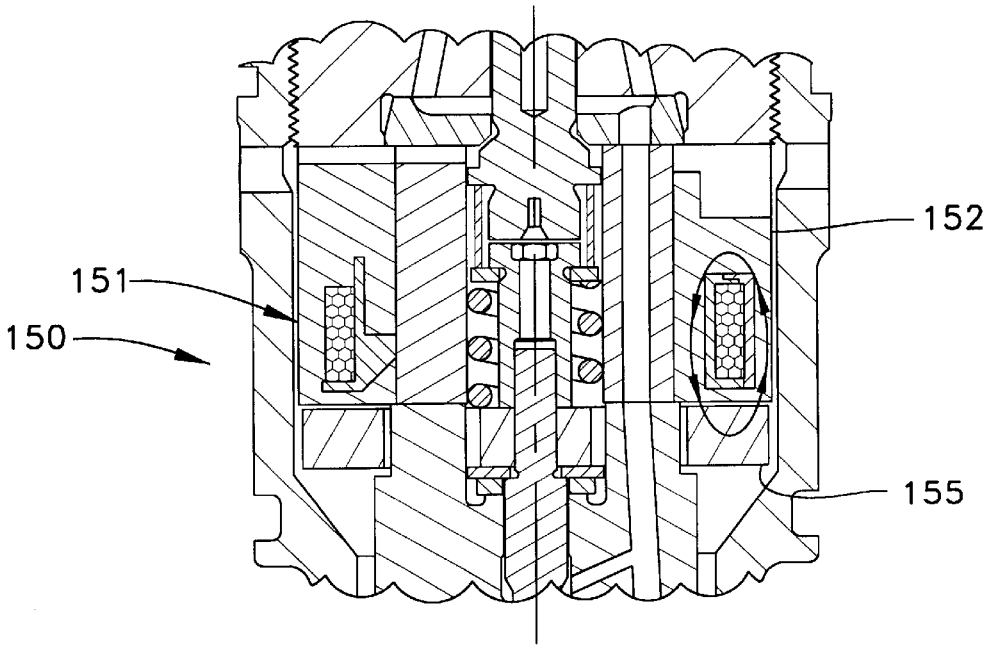
FIG. 3 is a partial sectioned side diagrammatic view of a dual pole solenoid controlled valve assembly for a fuel injector of the type shown in FIG. 1.

Referring now to FIGS. 2 and 3, the single pole valve assembly 50 of FIG. 2 can be contrasted with a dual or double pole solenoid valve assembly 150 of FIG. 3. Since the valving components and the stators 52 and 152 are nearly identical, the differences relate primarily to the size and shape of the armature as well as the addition of the magnetic flux ring in the single pole valve assembly 51. Those skilled in the art will appreciate that the double pole solenoid assembly 151 is simpler in its construction than the single pole solenoid of FIG. 2. This stems from the fact that one is mostly concerned with controlling the vertical air gap between the stator 152 and the armature 155 in the double pole assembly and maintaining a relatively large and not tightly controlled radial clearance between the armature 155 and the outer casing of the injector.

Figure 6:
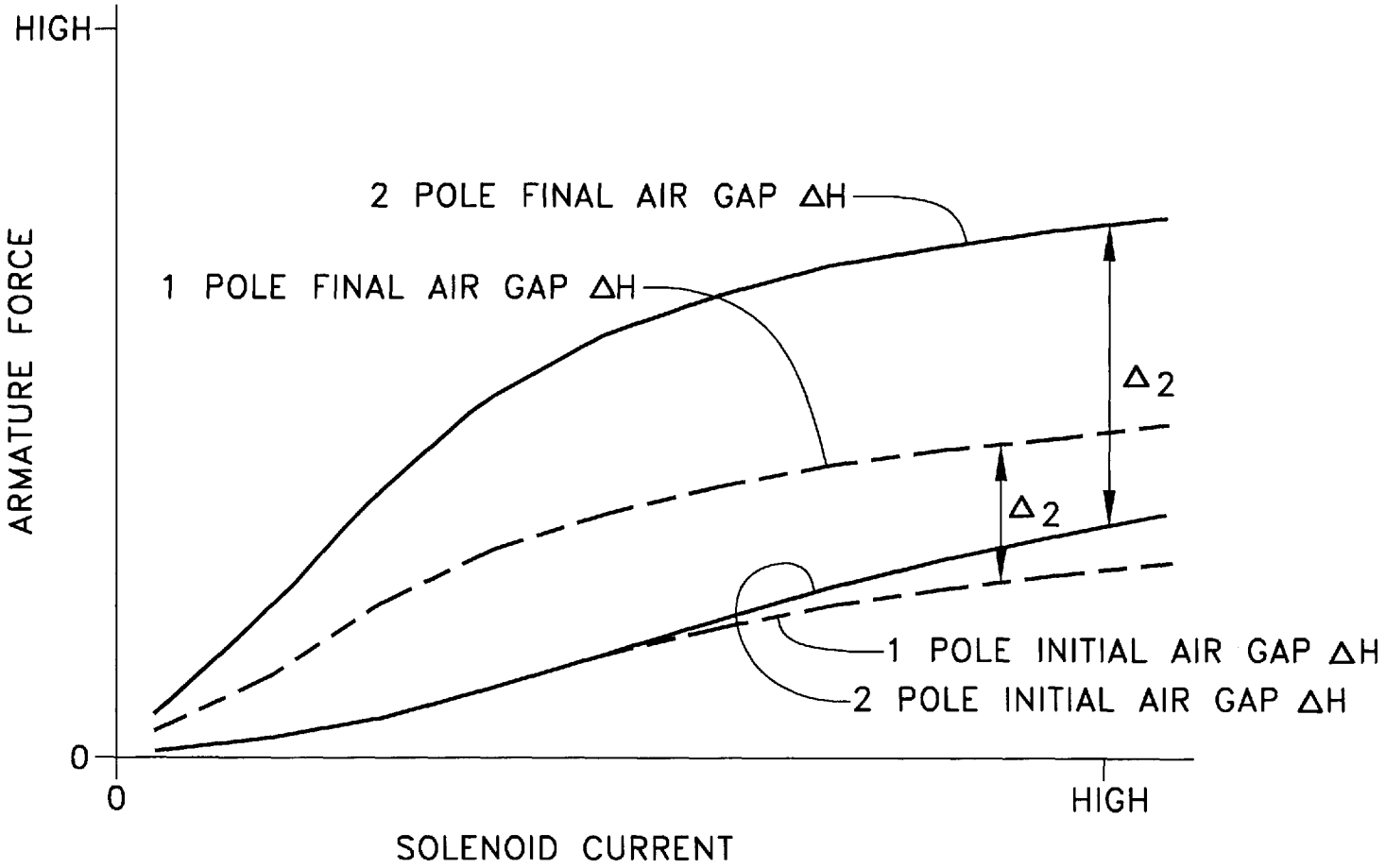
FIG. 6 is a graph of armature force versus solenoid current for initial and final air gaps of a single pole and dual pole solenoid assembly.

Referring now to FIGS. 2–4 and 6, the performance differences between the single pole and double pole solenoid assemblies is illustrated. The graph of FIG. 6 shows that the armature force at the initial air gap for the dual pole solenoid is almost always greater than or equal to that of the single pole solenoid assembly. The big difference appears when one compares the armature force at the final air gap (closest position to stator) between the single pole and dual pole solenoids. As can be seen, the dual pole solenoid produces substantially higher armature forces as the air gap decreases when the armature is moving toward the stator than that of the single pole counterpart. The result is that in general, double pole solenoids can often perform faster than their single pole solenoid counterparts. While the armature force produced by the single pole solenoid also increases as the armature moves closer to the stator, its initial and final forces vary far less than that of the dual pole solenoid counterpart. It is this phenomenon that renders the present invention especially advantageous as a three position solenoid. In order to perform properly, the armature of the present invention preferably has an intermediate position in which the armature force is balanced by the relatively strong counter force produced by needle control biasing spring 49. Thus, in the intermediate position, the spill valve member 20 is closed but needle control valve member 40 is still out of contact with conical valve seat 42. Because the single pole solenoid force increases less than that of its dual pole solenoid counterpart as air gap is reduced, the present invention can stop and hold the armature at an intermediate position with more stability than that of its dual pole solenoid counterpart. This is especially important in valving contacts such as fuel injectors where the difference between initial and final air gaps is on the order of tens of microns. Thus, the relatively lower but more uniform armature forces produced by the single pole solenoid results in the ability to better move the armature, and stop it at an intermediate position that is merely a delicate balancing of an armature force with that of a mechanical spring. Thus, the present invention sacrifices slightly in the area of speed in the movement of the armature and its attached valve members relative to the double pole solenoid design, but gains in its ability to produce solenoid assemblies that can be brought to a stable intermediate position in a manner that results in less variability from one assembly to another.

INDUSTRIAL APPLICABILITY

Referring back to FIG. 1, each injection event begins by the downward movement of tappet 13 and plunger 17. When this occurs, fuel in fuel pressurization chamber 19 is merely displaced back into fuel inlet 12 via fuel flow passage 22, past conical valve seat 23 and into spill passage 25. When the time comes to begin to raise pressure to injection levels, solenoid assembly 51 is provided with an intermediate current that moves armature 55, needle control valve member 40 and spill valve member 20 upward against the action of spill biasing spring 24. Spill biasing spring 24 has a relatively weak pre-load compared to the pre-load of needle control biasing spring 49 such that at the intermediate current levels, spring 49 is not compressed beyond its pre-load. At the inter-mediate current, needle control valve member 40 moves toward, but remains out of contact with conical valve seat 42, but spill valve member 20 moves up into contact with its conical valve seat 23 to close the same. When this occurs, fuel pressure in fuel pressurization chamber 19, nozzle supply passage 28 and nozzle chamber 29 rises rapidly to injection levels. However, because high pressure fuel is in fluid communication with needle control chamber 46, direct control needle valve 30 remains in its downward closed position. When it is desired to start the injection event, the current to single pole solenoid assembly 51 is increased such that needle control biasing spring 49 is compressed beyond its pre-load and needle control valve member 40 moves upward into contact with conical valve seat 42. When this occurs, the pressure in needle control chamber 46 drops quickly due to the vent clearance 35 as well as vent passage 37. When pressure in needle control chamber 46 becomes low, and the fuel pressure acting on lifting hydraulic surface 32 is above the valve opening pressure, needle valve member 31 will lift and open nozzle outlet 18 to commence the spraying of fuel into the combustion space within the engine. The injection event is ended by eliminating current to the solenoid assembly which results in needle control valve member 40 moving downward and high pressure once again acting in needle control chamber 46 to push direct control needle valve 30 downward towards its closed position.

Those skilled in the art will appreciate that the relatively low force gain of single pole solenoids having a structure of the type previously described renders them desirable in applications where the solenoid needs to stop at an intermediate position that is defined by a delicate balance between solenoid current and some biasing force, such as that produced by a mechanical spring. The relatively low force gain of the single pole solenoid of the present invention permits the armature to be moved toward and stopped at an intermediate position without a substantial overshooting of the type sometimes encountered with its double pole solenoid counterparts. This ability to reliably and relatively quickly move the armature and its associated valve members toward and stop them at the intermediate position provides the necessary flexible control over injection pressures and injection rate shapes independent of engine speed and load.

With the relatively high force gains associated with double pole solenoids in fuel injectors that are of the type shown in FIG. 3, it is often difficult to achieve consistent shot to shot injections because the armature intermediate position tends to sometimes be unstable. As the armature moves closer to the intermediate position, the forces increase rapidly, proportional to the corresponding reduction in air gap. Consequently, the armature assembly can sometimes compress the needle control biasing spring 49 beyond its pre-load resulting in over travel past the intermediate position. Even when the driver current to the double pole solenoid is briefly shut off, the solenoid force response is not fast enough to instantaneously eliminate the magnetic attraction between the stator and the armature in order to bring the armature to rest at an intermediate position.

One of the design challenges in the use of single pole solenoids of the type described is the need to tightly control the radial sliding air gap between the outer diameter of the armature and the inner diameter of the magnetic flux ring. In many previous single and double solenoids, various magnetic components of the solenoid assembly are guided and supported on two separate carriers, making concentric alignment of these parts a difficult manufacturing problem. The use of dowels and/or bolts to align these parts often limits the sliding air gap to a minimum of greater than 100 microns, which can significantly reduce force levels below an acceptable minimum. The present invention improves on this situation by virtue of the use of a magnetic flux ring that is guided on the same part as the armature. In other words, the magnetic flux ring is press fit on the outer diameter of body component 63, and is ground flat and parallel with the top surface of body component 63. This provides for line to line contact between the top of the magnetic flux ring and the bottom of the stator containing the coil when the injector is assembled. Since the armature and the magnetic flux ring are guided on the same precision part, the radial sliding air gap can be controlled with relatively low variability well below a 100 micron level.

This concentric coupling is accomplished by machining the inner diameter of the armature to have a close tolerance fit to the stem of the needle control valve member 40, which preferably has a match clearance fit to the guide bore 64. The outer diameter of the armature can then be tightly controlled relative to its own inner diameter and consequently to the valve body component 63. The resulting sliding gap between the armature outer diameter and the inner diameter of the magnetic flux ring is therefore not dependent on any loose tolerances such as dowels or bolts. This maximizes solenoid force by creating an efficient flux path from the magnetic flux ring across the small sliding air gap through the armature.

The above description is for illustrative purposes only and is not intended to limit the scope of the present invention in any way. For instance, those skilled in the art will appreciate that the single pole solenoid assembly of the present invention can find potential application in a wide variety of mechanisms apart from the fuel injector valve assembly previously described. Thus, modifications from the illustrated embodiment could be made without departing from the intended spirit and scope of the present invention, as defined by the claims set forth below.

What is claimed is:

1. A fuel injector comprising:

an injector body defining a fuel inlet, a fuel spill outlet and a nozzle outlet;

a direct control needle valve that includes a needle valve member positioned adjacent said nozzle outlet and including a closing hydraulic surface;

a control valve member positioned in said injector body;

a single pole solenoid attached to said injector body and including a stator, a magnetic flux ring with a central axis and an armature with a centerline attached to said control valve member; and said central axis and said centerline being concentrically coupled via an interaction between said magnetic flux ring and said armature via said injector body.

2. The fuel injector of claim 1 wherein said injector body includes a guide part; and said interaction includes said magnetic flux ring being mounted on a first surface of said guide part and said armature being guided in its movement by a second surface of said guide part.

3. The fuel injector of claim 2 wherein said stator, said armature and said magnetic flux ring are made of materials with a relatively low resistance to magnetic flux; and said control valve member and said guide part are made of a materials with a relatively high resistance to magnetic flux.

4. The fuel injector of claim 3 including a spill valve member operably connected to said armature and movable between a spill position and a closed position; and said control valve member is a needle control valve member movable between a first position in which said closing hydraulic surface is exposed to pressure in a high pressure passage and a second position in which said closing hydraulic surface is exposed to pressure in a low pressure passage.

5. The fuel injector of claim 4 wherein said armature has an intermediate position in which said spill valve member is in said closed position and said needle control valve member is at a middle position in which said closing hydraulic surface remains exposed to pressure in said high pressure passage.

6. The fuel injector of claim 5 wherein said stator is positioned on one side of a plane; and said armature and said magnetic flux ring are positioned on an opposite side of said plane.

7. A single pole solenoid assembly comprising:

a body;

a stator in a fixed position relative to said body;

a coil attached to said stator;

an armature having a centerline and being positioned adjacent said stator;

a magnetic flux ring having a central axis and an interior surface at least partially surrounding said armature;

said stator, said armature and said magnetic flux ring are positioned and arranged such that magnetic flux lines generated by said coil pass between said stator and said magnetic flux ring through said armature;

said central axis and said centerline being concentrically coupled via an interaction between said magnetic flux ring and said armature via said body.

8. The solenoid assembly of claim 7 wherein said interaction includes said magnetic flux ring being mounted on a first surface of said body and said armature being guided in its movement by a second surface of said body.

9. The solenoid assembly of claim 8 wherein said first surface is a cylindrical outer surface and said second surface is a cylindrical inner surface; and said cylindrical outer surface and said cylindrical inner surface share a common centerline.

10. The solenoid assembly of claim 7 wherein said body defines a guide bore; and a valve member attached to said armature and being slidably positioned in said guide bore.

11. The solenoid assembly of claim 10 wherein said body includes a conical valve seat; and said valve member moves between a first position that is in contact with said valve seat and a second position that is out of contact with said valve seat.

12. The solenoid assembly of claim 7 wherein said stator, said armature and said magnetic flux ring are made of materials with a relatively low resistance to magnetic flux; and said body is made of a material with a relatively high resistance to magnetic flux.

13. The solenoid assembly of claim 7 wherein said stator is positioned on one side of a plane; and said armature and said magnetic flux ring are positioned on an opposite side of said plane.

14. A solenoid controlled valve assembly comprising:

a valve body having a conical valve seat;

a valve member positioned in said valve body;

a single pole solenoid attached to said valve body and including a stator, a magnetic flux ring with a central axis and an armature with a centerline attached to said valve member;

said armature being movable between a first position in which said valve member is in contact with said valve seat and a second position in which said valve member is out of contact with said valve seat; and said central axis and said centerline being concentrically coupled via an interaction between said magnetic flux ring and said armature via said valve body.

15. The solenoid controlled valve assembly of claim 14 wherein said conical valve seat is a first conical valve seat, and said valve body includes a second conical valve seat;

said valve member is a first valve member, and said valve assembly includes a second valve member operably connected to said armature; and said second valve member being out of contact with said second conical valve seat when said armature is in said first position;

said second valve member being in contact with said second conical valve seat when said armature is in said second position; and said armature having a third position between said first position and said second position in which said first valve member is out of contact with said first conical valve seat but said second valve member is in contact with said second conical valve seat.

16. The solenoid controlled valve assembly of claim 14 wherein said armature is biased toward said first position by a low force spring and a high force spring; and said armature has a third position at which said low force spring is compressed beyond its pre-load but said high force spring is not compressed beyond its pre-load.

17. The solenoid controlled valve assembly of claim 14 wherein said valve body includes a guide part; and said interaction includes said magnetic flux ring being mounted on a first surface of said guide part and said armature being guided in its movement by a second surface of said guide part.

18. The solenoid controlled valve assembly of claim 17 wherein said first surface is a cylindrical outer surface and said second surface is a cylindrical inner surface; and said cylindrical outer surface and said cylindrical inner surface share a common centerline.

19. The solenoid controlled valve assembly of claim 14 wherein said stator, said armature and said magnetic flux ring are made of materials with a relatively low resistance to magnetic flux; and said valve body is made of a material with a relatively high resistance to magnetic flux.

20. The solenoid controlled valve assembly of claim 14 wherein said stator is positioned on one side of a plane; and said armature and said magnetic flux ring are positioned on an opposite side of said plane.

* * * * *